US005259349A

United States Patent [19]

Radlinski

[11] Patent Number: 5,259,349

[45] Date of Patent: Nov. 9, 1993

[54] DEVICE FOR THE ADJUSTMENT OF A THROTTLE VALVE

[75] Inventor: Andreas Radlinski, Oberursel, Fed. Rep. of Germany

[73] Assignee: VDO Adolf Schindling AG, Frankfurt, Fed. Rep. of Germany

[21] Appl. No.: 997,026

[22] Filed: Dec. 28, 1992

[30] Foreign Application Priority Data

Mar. 2, 1992 [DE] Fed. Rep. of Germany ..... 4206523

[51] Int. Cl.[5] ..... F02D 11/02; F02D 11/10

[52] U.S. Cl. ..... 123/399; 123/400

[58] Field of Search ..... 123/361, 399, 400

[56] References Cited

U.S. PATENT DOCUMENTS

| | | | |
|---|---|---|---|
| 4,873,957 | 10/1989 | Ueyama et al. | 123/399 |
| 4,919,097 | 4/1990 | Mitui et al. | 123/399 |
| 4,953,529 | 9/1990 | Pfalzgraf et al. | 123/399 X |
| 5,038,733 | 8/1991 | Westenberger | 123/399 X |
| 5,131,360 | 7/1992 | Muschalik | 123/399 X |
| 5,134,979 | 8/1992 | Pfalzgraf | 123/399 |
| 5,161,506 | 11/1992 | Mausner et al. | 123/399 |
| 5,172,668 | 12/1992 | Gohring et al. | 123/399 |

OTHER PUBLICATIONS

VDI Report No. 819, pp. 741-763, Jan. 1990.

*Primary Examiner*—Willis R. Wolfe

*Attorney, Agent, or Firm*—Martin A. Farber

[57] ABSTRACT

For the displacement of a throttle valve (1) which is rotatably mounted in the intake connection (2) of an internal combustion engine, there is provided a device with electromotive actuating drive, gearing and clutch (10) as well as electronic control device (11) with which the entire load range, in addition to the idle range, can be automatically controlled. In this connection, a coupling member (15) is provided between the pulley (8), which is mechanically coupled to the gas pedal (6), and a first lever (13) which is rigidly attached to the throttle-valve shaft (1a). Furthermore, the main return spring (3) acts directly on the pulley (8), the coupling member (15) is urged by a coupling spring (16) against the first lever (13) of the throttle-valve shaft (1a), and a third return spring (19) acts on the driven shaft (18) of the actuating drive (9)

8 Claims, 1 Drawing Sheet

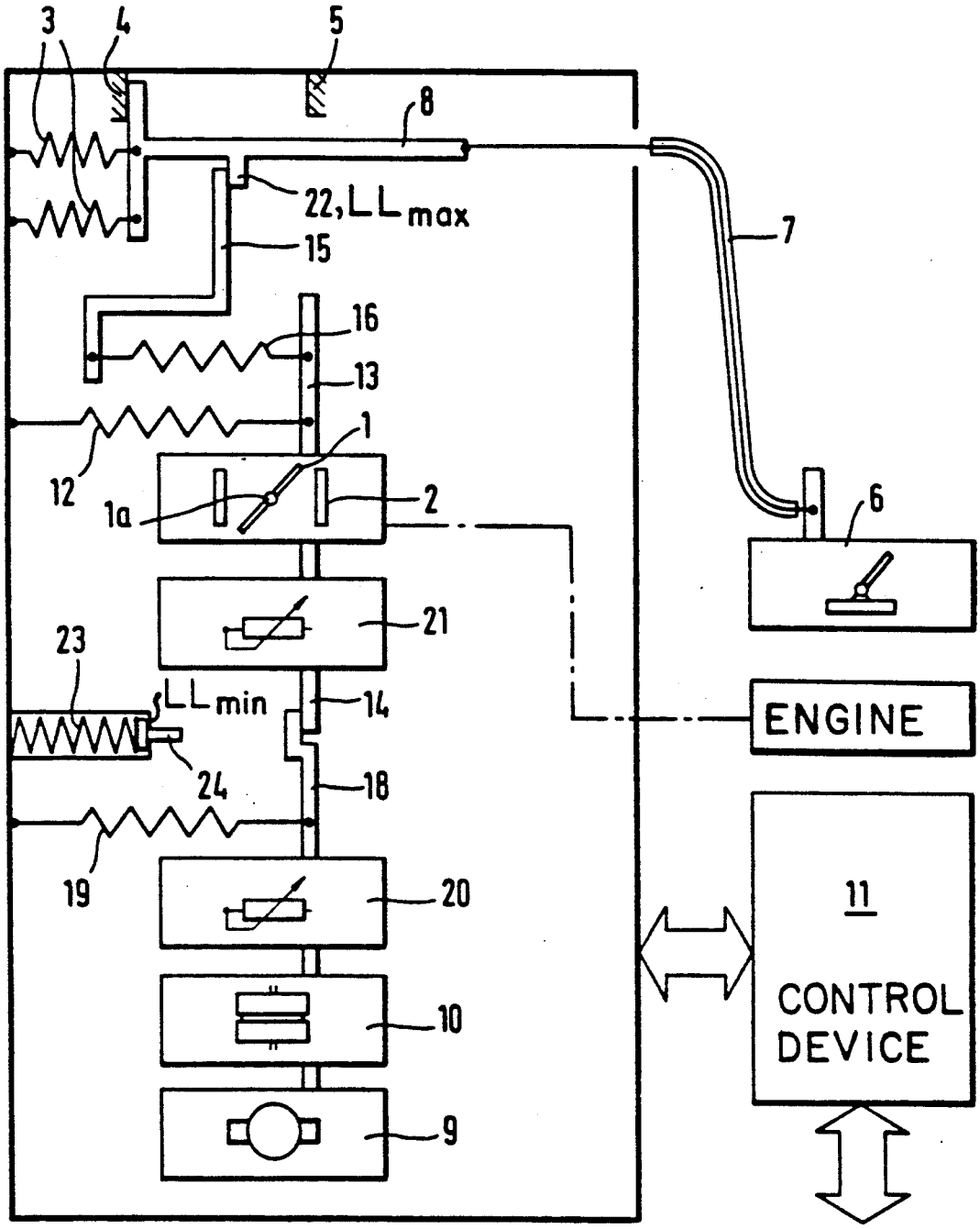
3
4
5
8
22, LL max
15
7
16
13
1
12
1a
2
6
21
23
LL min
14
ENGINE
24
18
19
20
11
CONTROL DEVICE
10
9

DEVICE FOR THE ADJUSTMENT OF A THROTTLE VALVE

FIELD AND BACKGROUND OF THE INVENTION

The present invention relates to a device for adjusting a throttle valve (1) which is mounted in the intake connection (2) or manifold of an internal combustion engine, the device comprising

- a cable pulley (8) which can be displaced, against the force of a first return spring (3), between an idle operation stop (4) and a full-load stop (5) by means of a gas pedal (6) and a rod or cable (7) and can be coupled to the shaft of the throttle valve (1*a*),
- an electromotive actuating drive (9) with gearing and clutch (10),
- an electronic control device (11),
- a throttle valve (1) which can turn against the force of a second return spring (12) and has a first lever (13) connected, fixed for rotation, to the throttle-valve shaft (1*a*) for coupling to the pulley (8), and a second lever (14) connected, fixed for rotation, to the throttle-valve shaft (1*a*) for coupling to an actuating drive, as well as
- a coupling member (15) between pulley (8) and the first lever (13).

A device of this type is known from VDI Report No. 819 (1990), pages 741–763. In that case, the coupling member between pulley and the first lever, which is rigidly attached to the throttle-valve shaft, is urged by means of a spring ($F_{R1A}$ and $F_{R1B}$) in the idling direction of the throttle valve towards the pulley. Furthermore, two stops are provided on the coupling member in order to define the idle control range (LLR range). The first lever, which is rigidly attached to the throttle-valve shaft, is movable back and forth between these stops by the cooperation of the electromotive actuating device with the return spring ($F_{R3}$) without the coupling member changing its position. In other words, when the gas pedal is completely released and the coupling member lies against the idle stop, regulation of the throttle valve position between the smallest possible and largest possible idle positions ($LL_{min}$, $LL_{max}$) can be effected via the electromotive actuating drive as determined by the electronic control device. However, if it is desired to use the known device also for the electromotive control of the position of the throttle valve between idle and full load, i.e. for the automatic actuating of a predetermined speed (without use of the gas pedal), then the actuating drive must be sufficiently strong also to tension the return spring on the coupling member, two of which springs are provided for the sake of redundancy ($F_{R1A}$, $F_{R1B}$). The drive in the known device had to be designed for a torque about 50 to 60% greater than in the case of a pure idle control. In other words, it was necessary to provide a correspondingly larger drive motor, a larger gearing, and a stronger coupling, which necessarily results in a larger overall volume and a greater weight.

Furthermore, a larger electromotive actuating drive also affects the design of the return springs, as a result of which further enlargement of the electromotive actuating drive may be necessary.

SUMMARY OF THE INVENTION

It is an object of the invention so further to develop the known device in order that the electromotive actuating drive can be used also for the control range between idle and full load without having to have recourse to a substantially stronger drive.

According to the invention:

a) the return spring (3) acts directly on the pulley (8);

b) the coupling member (15) is urged by a coupling spring (16) against the first lever (13) of the throttle-valve shaft (1*a*); and c) a third return spring (19) acts on the driven shaft (18) of the actuating drive (9).

Since the first return spring acts directly on the pulley, when the gas pedal is fully released, the electromotive actuating drive need only, within the control range between idle and full load, in addition to the spring force acting in the closing direction within the idle range, tension the coupling spring, which can be made considerably smaller than the first return spring, to enable use of an actuating motor which need be designed for a torque which is only 7 to 10% greater than an actuating motor which is designed exclusively for the control of the idle range. In this way, considerable savings in weight and space are possible, which is a great advantage, in particular in the case of passenger cars.

It is another feature of the invention that an actual-value transmitter (20) is associated with the electromotive actuating drive (9).

Further according to the invention, the throttle valve (1) has an actual-value transmitter (21) associated with it.

Still another feature of the invention is that a stop $LL_{max}$ (22) for the coupling member (15) is provided on the pulley (8).

Also, the invention provides a stop (24) which is movable against the force of a return spring (23) in order to define an emergency-operating position of the actuating drive (9).

BRIEF DESCRIPTION OF THE DRAWING

With the above and other objects and advantages in view, the present invention will become more clearly understood in connection with the detailed description of a preferred embodiment, when considered with the accompanying drawing, of which the sole figure is a diagrammatic representation of the device in accordance with the invention.

DETAILED DESCRIPTION OF THE PREFERRED EMBODIMENT

In order to explain the various functions of a device for adjusting the throttle valve of an internal combustion engine, the so-called linear showing employed here has been developed in which the processes effected in practice predominantly by rotation of the structural parts are shown as transverse movements in the plane of the drawing.

The throttle valve 1, which is mounted for rotation in the intake connection 2 or manifold of an internal combustion engine, can, in the present case, be displaced both by the driver of a motor vehicle by means of the gas pedal 6, rod or cable 7 and pulley 8, and by the electromotive actuating drive 9 via a gearing (not shown) and the clutch 10. In this connection, the setting range of the pulley 8 extends from the idle stop 4 to the full-load stop 5. The pulley 8 is urged in the closed direction of the throttle valve 1 by a first return spring 3, two of which are provided for reasons of redundancy.

The throttle valve 1 can be moved in the opening direction, on the one hand, by the pulley 8 via a coupling member 15 and a first lever 13 which is rigidly fastened to the shaft 1*a* of the throttle valve and, on the other hand, by the actuating motor 9 via its driven shaft 18 and a second lever 14 which is rigidly connected to the throttle-valve shaft 1*a*. The throttle valve 1 is moved in the closing direction by the second return spring 12 on the lever 13, while the third return spring 19 acts in closing direction on the driven shaft 18 of the actuating drive 9.

Actual-value transmitters 21 and 20 are provided for the lever 14 and the secondary shaft 18 respectively, and are coupled electrically to the control device 11 so that the positions of the lever 14 and the shaft 18 can be compared in the electronic control device 11 with the pre-established desired value. The pre-established desired value can be calculated, for instance, from the difference between a vehicle speed predetermined by the driver of the vehicle and the actual speed of the vehicle.

Furthermore, there is also shown an emergency operation device which consists of a movable stop 24 and a return spring 23 and which acts on the drive 18 of the actuating drive 9.

FIG. 1 shows the gas pedal 6 in its fully released position, the pulley 8 which is mechanically coupled with it resting against the idle stop 4 under the influence of the first return spring 3. However, the throttle valve 1 has been displaced by the electromotive actuating drive 9, the clutch 10, and the driven shaft 18, with the tensioning of the second and third return springs 12, 19, into a position above the maximum idle position, as can be recognized by the fact that the coupling member 15 rests against the stop $LL_{max}$ 22 and that the lever 13 does not rest against the coupling member 15 but is lifted off of it in the opening direction (i.e. to the right) with the tensioning of the coupling spring 16. This position corresponds to the case of automatic speed control, with which a value of, for instance, 120 km/hr is pre-established by the driver, and the electronic control device 11 provides that the predetermined speed is maintained when the gas pedal is entirely released. In other words, the electromotive actuating drive 9 is controlled in this way, until the throttle valve 1 assumes a position in which the actual speed agrees with the desired speed with due consideration of other parameters (up-grade, down-grade, load of the vehicle, etc.).

If a desired speed is not predetermined by the driver, the device of the invention controls only the idle range with the gas pedal completely unactuated. In such case, the coupling spring 16 remains untensioned and the lever 13 rests against the coupling member 15.

Electromotive control of the idle range is being constantly more frequently provided, particularly on passenger vehicles, so as actively to adapt the output of the internal combustion engine to the specific requirement with the gas pedal unactuated, depending on what additional loads (windshield heating, light, air conditioner, radio, etc.) are connected, with the vehicle stationary. Such a control is much more economical than one which can be obtained with a simple idle stop.

As part of the idle control, an emergency operating device is then also provided so that, in case of failure of the actuating drive or of the control device 13, the throttle valve 1 is swung into a position in which the internal combustion engine does not stall under the customary idle loads. This is provided by the stop 24 which can be displaced towards the left by the secondary drive 18, with tensioning of the return spring 23, until the drive 18 rests against the housing surrounding the return spring 23. This is the position of minimum opening of the throttle valve, which is also designated $LL_{min}$. If the actuating drive 9 or the control device 11 fails in this position, then the driven shaft 18 is shifted towards the right, and therefore in the direction of the opening of the throttle valve 1, up into the position of the stop 24 shown. This position is defined by limitation of the path of the return spring 23. If the actuating drive 9 or the control device 11 fails when the throttle valve 1, with the gas pedal 6 fully released, has been swung by the actuating drive 9 into a position above the emergency-operation position (stop 24), then the actuating drive 9 is swung by the third return spring 19 and the throttle valve 1 by the second return spring 12 towards the left up to against the stop 24, i.e. into the emergency-operation position. In this connection, the return springs 12 and 19 and the return spring 23 are of course so designed that the stop 24 cannot be shifted towards the left and therefore into a position below the emergency-operation position.

On the other side, the idle position with the largest opening of the throttle valve 1, also called $LL_{max}$, when the gas pedal 6 is not actuated, is defined by the stop 22 on the pulley 8. This position can be fixed by a contact or via the current consumption of the actuating drive 9 which is modified as a result of the tensioning of the coupling spring 16.

I claim:

1. A device for adjusting a throttle valve which is mounted in the intake connection of an internal combustion engine, the device comprising a first return spring, an idle operation stop, a full load stop, a gas pedal, a rod or cable connecting with the gas pedal, a throttle valve with a shaft, and a cable pulley which can be displaced, against the force of the first return spring between the idle operation stop and the full-load stop by means of the gas pedal and the rod or cable for coupling to the shaft of the throttle valve;

an electromotive actuating drive with gearing and clutch, a driven shaft driven by the actuating drive via the gearing and the clutch;

an electronic control device, a coupling spring, a second return spring, a first lever, a second lever, a coupling member between the pulley and the first lever, and a third return spring;

wherein the throttle valve can turn against the force of the second return spring;

the first lever is connected, fixed for rotation, to the throttle-valve shaft for coupling to the pulley; the second lever is connected, fixed for rotation, to the throttle-valve shaft for coupling to the actuating drive;

the first return spring acts directly on the pulley;

the coupling member is urged by the coupling spring against the first lever of the throttle-valve shaft; and the third return spring acts on the driven shaft of the actuating drive.

2. A throttle-valve adjustment device according to claim 1, further comprising an actual-value transmitter operatively coupled to the electromotive actuating drive for signaling to the electric control device a position of the driven shaft.

3. A throttle-valve adjustment device according to claim 2, further comprising an actual-value transmitter operatively coupled to the throttle valve for signaling to the electronic control device a position of the throttle valve.

4. A throttle-valve adjustment device according to claim 1, further comprising an actual-value transmitter operatively coupled to the throttle valve for signaling to the electronic control device a position of the throttle valve.

5. A throttle-valve adjustment device according to claim 3, further comprising a maximum idle stop for the coupling member and located on the pulley.

6. A throttle-valve adjustment device according to claim 1, further comprising a maximum idle stop for the coupling member and located on the pulley.

7. A throttle-valve adjustment device according to claim 5, further comprising an emergency stop and an emergency return spring, the emergency stop being movable against the force of the emergency return spring in order to define an emergency-operating position of the actuating drive.

8. A throttle-valve adjustment device according to claim 1, further comprising an emergency stop and an emergency return spring, the emergency stop being movable against the force of the emergency return spring in order to define an emergency-operating position of the actuating drive.

* * * * *